US006844511B1

(12) United States Patent
Hsu et al.

(10) Patent No.: US 6,844,511 B1
(45) Date of Patent: Jan. 18, 2005

(54) MULTI-FUNCTION CONTROL KEY STRUCTURE

(75) Inventors: Ming-Chun Hsu, Taipei (TW); Hsien-Pin Tsou, Taipei (TW); Bo-Shiun Luo, Taipei (TW)

(73) Assignee: Tatung Co., Ltd., Taipei (TW)

( * ) Notice: Subject to any disclaimer, the term of this patent is extended or adjusted under 35 U.S.C. 154(b) by 0 days.

(21) Appl. No.: 10/811,884

(22) Filed: Mar. 30, 2004

(30) Foreign Application Priority Data

Feb. 4, 2004 (TW) ..... 93102496 A

(51) Int. Cl.[7] ..... H01H 25/04
(52) U.S. Cl. ..... 200/6 A; 200/5 R
(58) Field of Search ..... 200/4, 5 R, 6 A, 200/17 R, 18; 345/161

(56) References Cited

U.S. PATENT DOCUMENTS 6,084,189 A * 7/2000 Menche et al. ..... 200/315
6,225,579 B1 * 5/2001 Ritter et al. ..... 200/6 A
6,525,280 B2 * 2/2003 Chan et al. ..... 200/6 A
6,635,832 B1 * 10/2003 Oster et al. ..... 200/6 A
6,750,408 B2 * 6/2004 Inoue et al. ..... 200/6 A

* cited by examiner

*Primary Examiner*—Michael A. Friedhofer
(74) *Attorney, Agent, or Firm*—Bacon & Thomas PLLC

(57) ABSTRACT

A multi-function control key structure formed of a key cap and a springy key body is disclosed for different triggering controls by means of a center shank of the key cap and a plurality of triggering rods of the key body around the center shank. The key cap has driving rods spaced above the triggering rods and adapted to drive the triggering rods to make a triggering action respectively. The center shank is tilted so as not to make a triggering action accidentally when the key cap is biased to force one triggering rod of the key body to make a triggering action. The driving rods do not touch the triggering rods when pressed the center area of the key cap to force the center shank to make a triggering action.

4 Claims, 6 Drawing Sheets

MULTI-FUNCTION CONTROL KEY STRUCTURE

BACKGROUND OF THE INVENTION

1. Field of the Invention

The present invention relates to a multi-function control key structure for an electronic device, for example, a computer, video cassette player/recorder, remote controller, etc.

2. Description of Related Art

An electronic consumer product may be provided with a so-called multi-function key assembly, which has a button exposed to the outside for multiple function controls, for example, up, down, left, right controls.

Regular multi-function key assemblies include two types, namely, the so-called 4-in-1 and the so-called 5-in-2. A 4-in-1 multi-function key assembly provides up, down, left, and right control functions. If an electronic device needs more than four control functions, a 4-in-1 multi-function key assembly cannot meet the requirement. Further, a 5-in-2 multi-function key assembly comprises an outer key unit and a center key unit. The outer key unit provides up, down, left, right controls. The center key is for another function control. A 5-in-2 multi-function key assembly settles the insufficient function control problem of a 4-in-1 multi-function key assembly, however the additional center key unit greatly complicates the manufacturing process and increases the manufacturing cost.

Further, U.S. Pat. No. 6,441,753 discloses a multi-function key assembly for electronic device. This design of multi-function key assembly is applicable for 8 different function controls. However, this design of multi-function key assembly uses a big number of parts. Further, the button of this design of multi-function key assembly may not return to its former position after having been pressed,

SUMMARY OF THE INVENTION

It is the main object of the present invention to provide a multi-function control key structure, which is formed of only two parts that are easy and inexpensive to manufacture and, which prevents erroneous triggering during operation.

To achieve this and other objects of the present invention, the multi-function control key structure is formed of a springy key body and a key cap mounted in the springy key body. The key body comprises a flat annular base, an annular flange protruded from one side of the flat annular base, a center through hole surrounded by the annular flange, and a springy plate disposed in the center through hole. The springy plate comprises a center through hole and a plurality of first spring arms and second spring arms equiangularly arranged around the center through hole of the springy plate. The first spring arms are respectively connected to the flat annular base, each having a middle mounting hole. Each second spring arm has a free end terminating in a downwardly extended triggering rod. The key cap is mounted in the center through hole in the annular flange of the springy key body, comprising a bottom wall, a shank perpendicularly downwardly extended from the center of the bottom wall and inserted into the center through hole of the springy plate, a plurality of driving rods perpendicularly downwardly extended from the bottom wall and equiangularly arranged spaced around the shank corresponding to the triggering rods of the second spring arms, and a plurality of locating rods perpendicularly downwardly extended from the bottom wall and equiangularly arranged around the shank and respectively fastened to the mounting holes of the first spring arms to cause said driving rods respectively spaced from the triggering rods of said second spring arms at a predetermined distance.

When pressing the border area of the key cap to force one driving rod against the respective triggering rod of the key body, the respective triggering rod trigger the respective key switch. At this time, the key cap is tilted to bias the shank, preventing an accidental triggering action of the shank. When pressing the center area of the key cap to force the shank to trigger the respective key switch, the action does not cause the triggering rods to make an accidental triggering action because the driving rods are kept away from the triggering rods at a distance.

DETAILED DESCRIPTION OF THE PREFERRED EMBODIMENT

Figure 1:
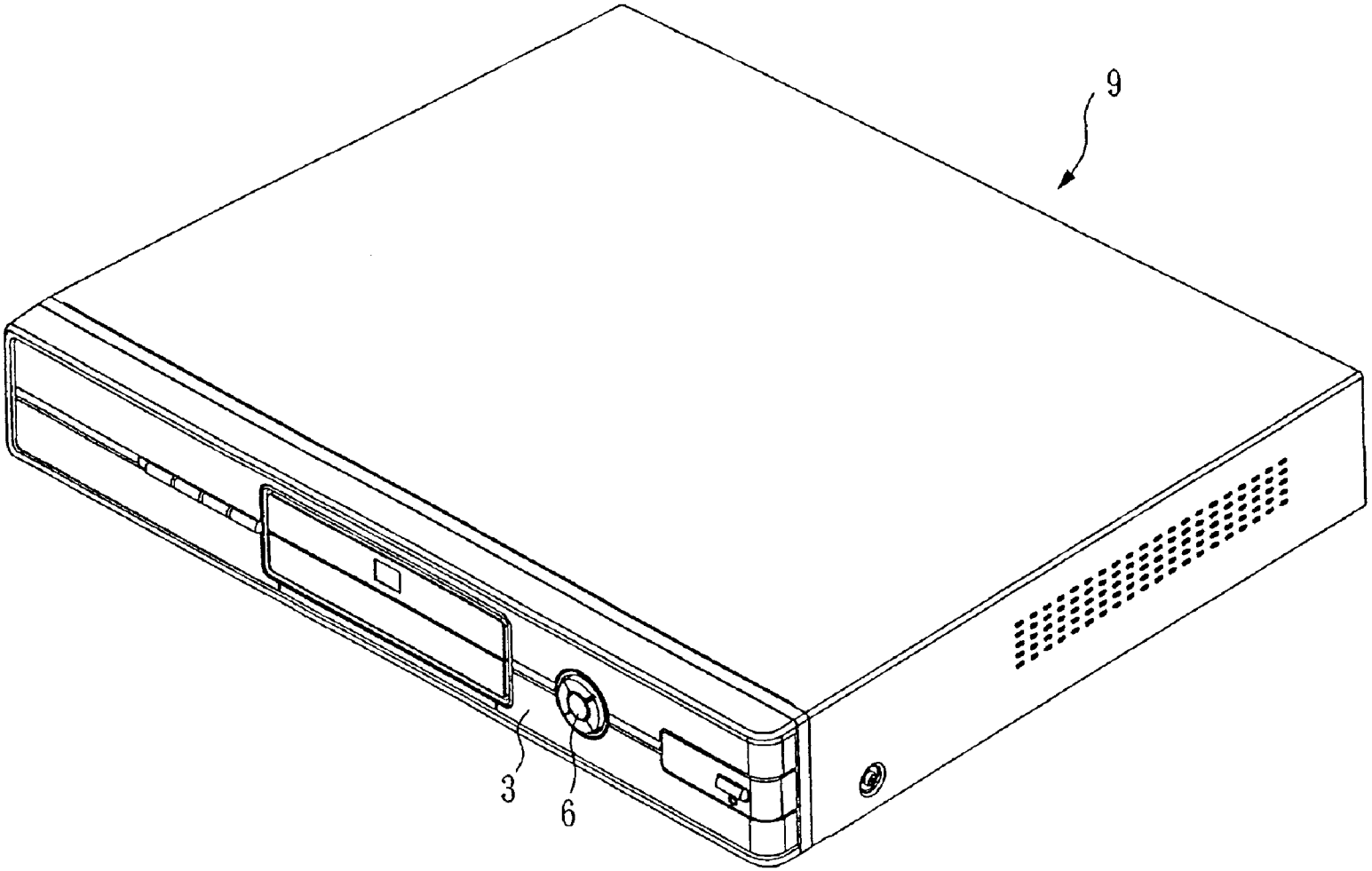
FIG. 1 is an applied view showing a multi-function control key structure installed in a computer according to the present invention.

In FIG. 1, a computer 9 is shown having a front face panel 3 and a multi-function control key structure 6 installed in the front face panel 3.

Figure 2:
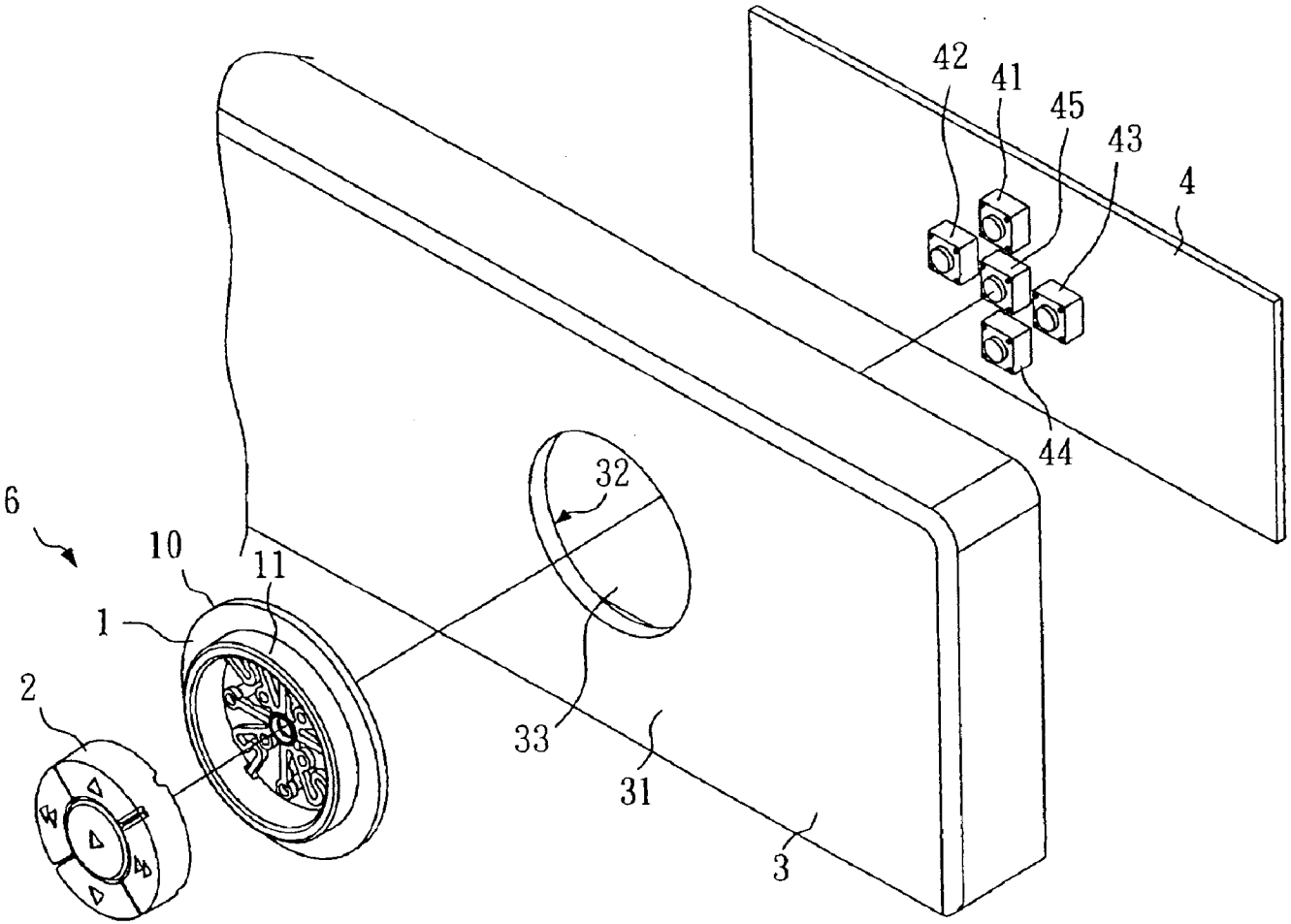
FIG. 2 is an exploded view in an enlarged scale of a part of FIG. 1.

Referring to FIG. 2 and FIG 1, the front face panel 3 has an outer surface 31, an inner surface 32, and a through hole 33 extended through the outer surface 31 and the inner surface 32. The multi-function control key structure 6 comprises a springy key body 1 and a key cap 2. The key body 1 and the key cap 2 are installed in the front face panel 3.

Figure 3:
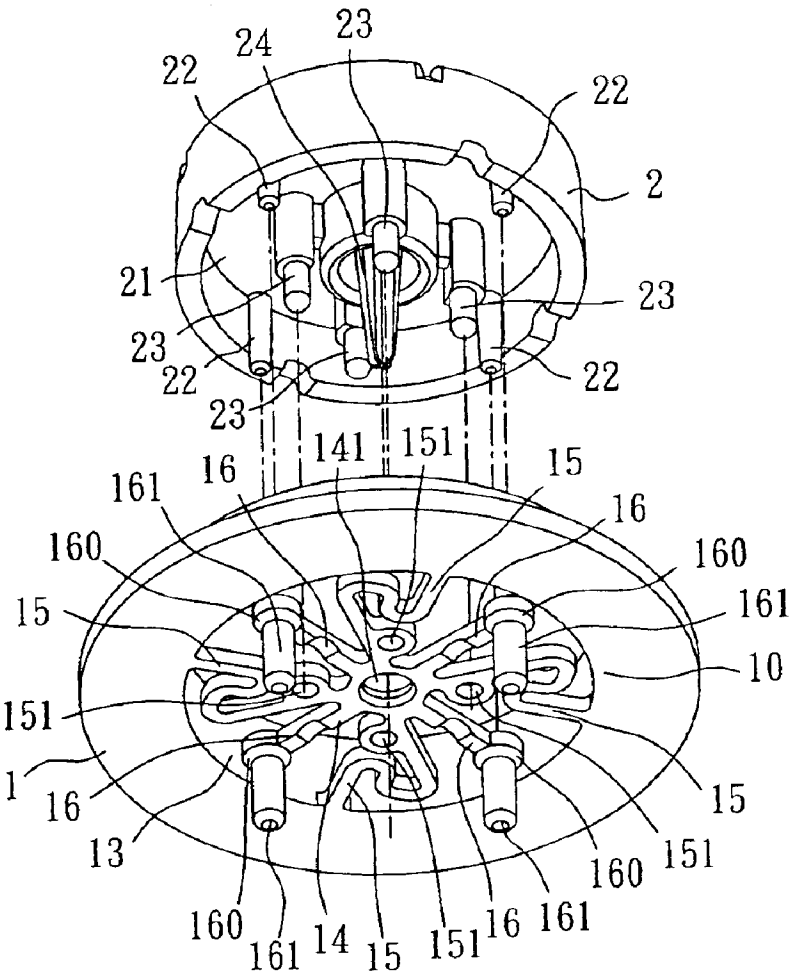
FIG. 3 is an exploded, oblique bottom view of the multi-function control key structure according to the present invention.
Figure 4:
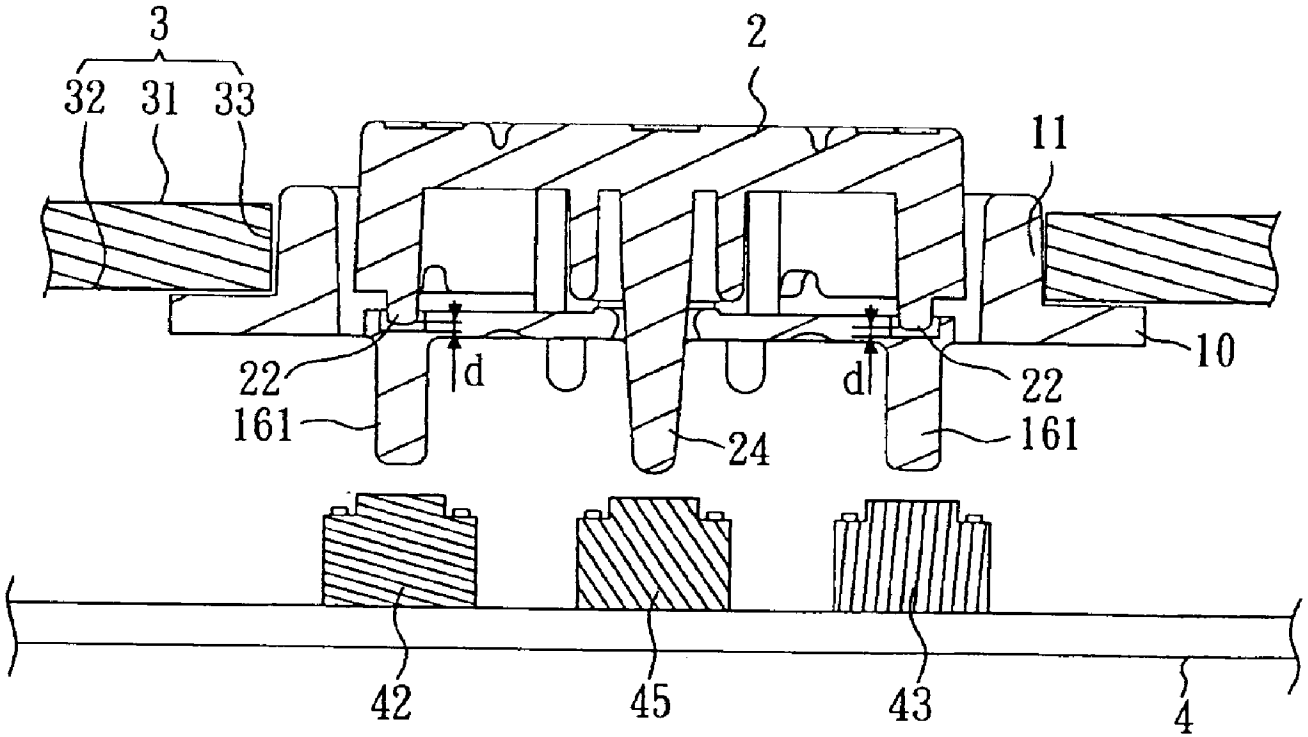
FIG. 4 is a sectional view of the multi-function control key structure according to the present invention.

Referring to FIGS. 3 and 4 and FIGS. 1 and 2 again, the key body 1 comprises a flat annular base 10 and an annular flange 11 protruded from one side of the flat annular base 10 around the inner diameter of the flat annular base 10. The annular flange 11 is inserted into the through hole 33 of the front face panel 3. The flat annular base 10 is bonded to the inner surface 32 of the front face panel 3 by heat sealing.

Further, the annular flange 11 of the key body 1 defines a center through hole 13. The key body 1 further comprises a springy plate 14 disposed in the center through hole 13. The springy plate 14 comprises a center through hole 141 disposed in axial alignment with the center through hole 13 in the annular flange 11, four equiangularly outwardly extended first spring arms 15, and four equiangularly outwardly extended second spring arms 16. The first spring arms 15 are respectively connected to the flat annular base 10 of the key body 1, each having a middle mounting hole 151. Each second spring arm 16 has a free end 160 and a triggering rod 161 downwardly extended from the free end 160.

Further, the key cap 2 is mounted in the center through hole 13 in the annular flange 11, comprising a bottom wall 21, a shank 24 perpendicularly downwardly extended from the center of the bottom wall 21 and inserted into the center through hole 141 of the springy plate 14, four driving rods 22 perpendicularly downwardly extended from the bottom wall 21 and equiangularly spaced around the shank 24 corresponding to the triggering rods 161 of the second spring arms 16, and four locating rods 23 perpendicularly downwardly extended from the bottom wall 21 and equiangularly spaced around the shank 24 and respectively bonded to the mounting holes 151 of the first spring arms 15 by heat sealing. After installation of the key cap 2 in the key body 1, the driving rods 22 are respectively kept away from the root of each triggering rod 161 at a predetermined distance d.

During installation of the key body 1 and the key cap 2 in the front face panel 3, the triggering rods 161 of the key body 1 and the shank 24 of the key cap 2 protrude over the inner surface 32 of the front face panel 3 and are respectively aimed at five key switches 41~45 of a circuit board 4, wherein the shank 24 of the key cap 2 is aimed at the center key switch 45; the triggering rods 161 of the key body 1 are respectively aimed at the other four key switches 41~44 around the center key switch 55.

As indicated above, the multi-function control key structure 6 is formed of the springy key body 1 and the key cap 2, and capable of triggering the center key switch 45 by means of the shank 24 or the key switches 41~44 by means of the driving rods 22 of the key cap 2 via the triggering rods 161 of the key body 1 respectively.

Figure 5:
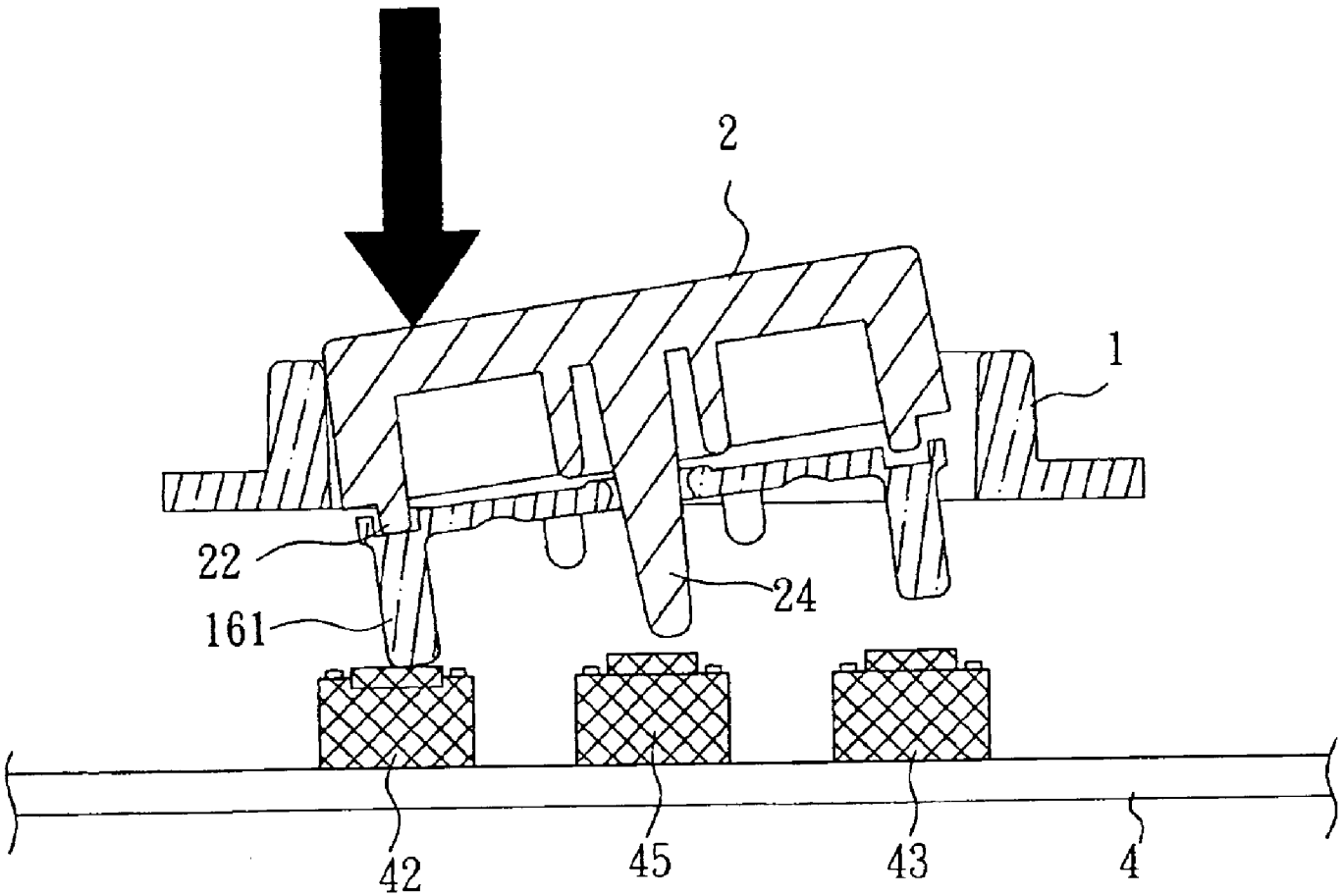
FIG. 5 is a schematic drawing showing one operation action of the multi-function control key structure according to the present invention.

Referring to FIG. 5 and FIGS. 2~4 again, when wishing to trigger one of the key switches 41~44 around the center key switch 41, directly press the border area of the key cap 2 to force the corresponding driving rod 22 against the respective triggering rod 161 of the key body 1 as shown in FIG. 5, thereby causing the respective triggering rod 161 to trigger the respective key switch 42. Because the key cap 2 is tilted at this time, the shank 24 is biased from the triggering position, preventing triggering of the center key switch 45 by the shank 24 accidentally.

Referring to FIG. 6 and FIGS. 2~4 again, when wishing to trigger the center key switch 45, directly press the center area of the key cap 2 to force the shank 24 against the center key switch 45. Because the driving rods 22 are respectively kept away from the triggering rods 161 at a distance d, which is greater than the down stroke of the shank 24 to trigger the center key switch 45, triggering the center key switch 45 by the shank 24 does not cause the triggering rods 161 to trigger the other key switches 41~44 accidentally.

Figure 6:
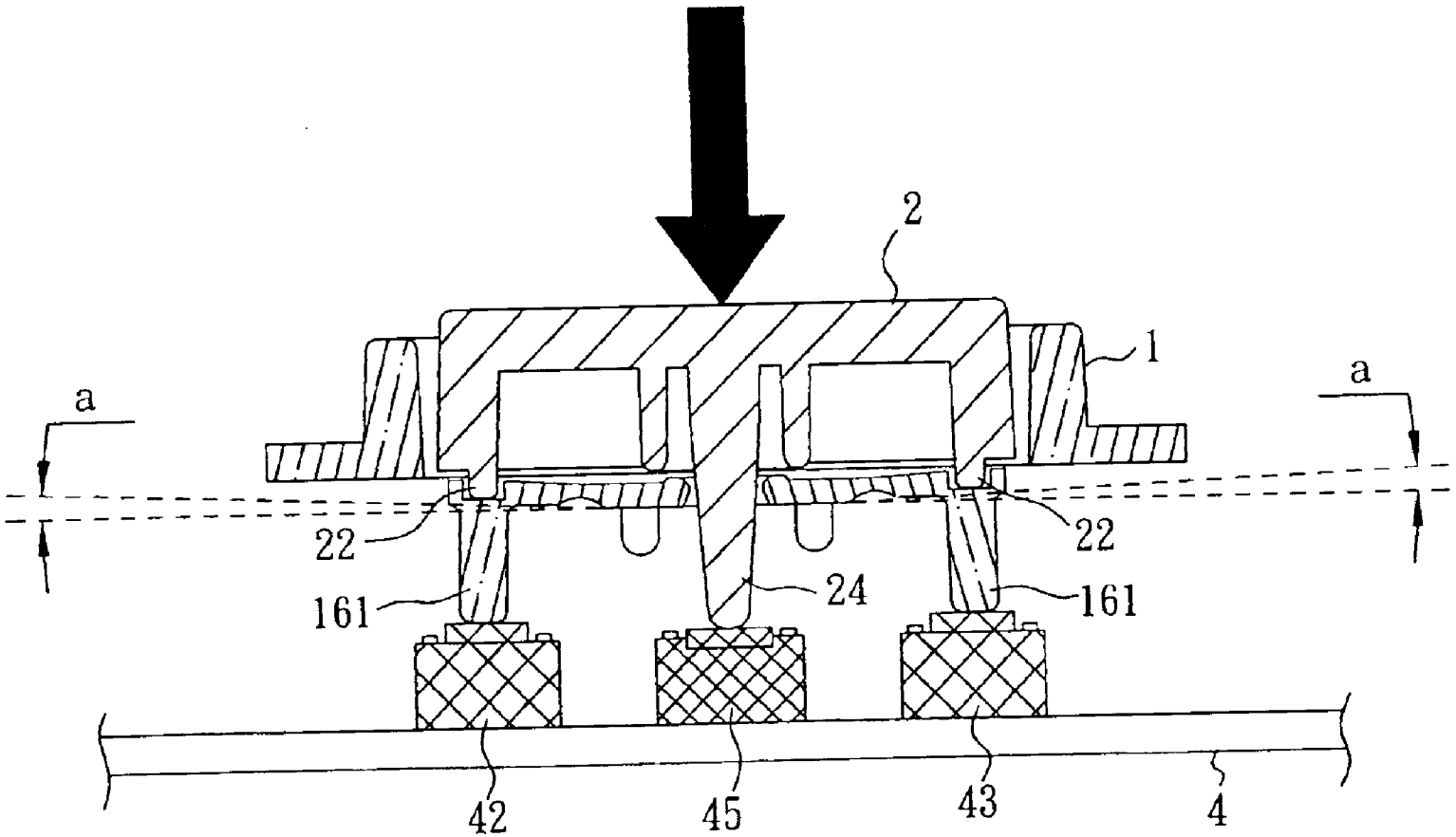
FIG. 6 is a schematic drawing showing another operation action of the multi-function control key structure according to the present invention.

If the user pressed the key cap 2 with an excessive force to force the triggering rods 161 to touch the other key switches 41~44 around the center key switch 45 accidentally, at this time the prestress of the key switches 41~44 and the spring prestress of the second spring arms 16 cause the springy plate 14 to curve upwards through an angle "a" as shown in FIG. 6, preventing triggering of the key switches 41~44 erroneously.

In the aforesaid preferred embodiment, the number of the triggering rods 161 of the key body 1 and the number of the driving rods 22 of the key cap 2 are 4. The number of the triggering rods 161 of the key body 1 and the number of the driving rods 22 of the key cap 2 may be changed to 5 or even more for controlling more key switches. When changing the design, the size of the key body 1 and the key cap 2 may be relatively increased.

Although the present invention has been explained in relation to its preferred embodiment, it is to be understood that many other possible modifications and variations can be made without departing from the scope of the invention as hereinafter claimed.

What is claimed is:

1. A multi-function control key structure comprising:

a springy keybody, said springy key body comprising a flat annular base, an annular flange protruded from one side of said flat annular base, a center through hole surrounded by said annular flange, and a springy plate disposed in said center through hole, said springy plate comprising a center through hole and a plurality of first spring arms and second spring arms equiangularly arranged around the center through hole of said springy plate, said first spring arms being respectively connected to said flat annular base, each of said first spring arms having a middle mounting hole, each of said second spring arms, having a free end terminating in a downwardly extended triggering rod; and a key cap mounted in the center through hole in the annular flange of said springy body, said key cap comprising a bottom wall, a shank perpendicularly downwardly extended from the center of said bottom wall and inserted into the center through hole of said springy plate, a plurality of driving rods perpendicularly downwardly extended from said bottom wall and equiangularly arranged around said shank corresponding to the triggering rods of said second spring arms, and a plurality of locating rods perpendicularly downwardly extended from said bottom wall and equiangularly arranged around said shank and respectively fastened to the mounting holes of said first spring arms to cause said driving rods respectively spaced from the triggering rods of said second spring arms at a predetermined distance.

2. The multi-function control key structure as claimed in claim 1, wherein said springy key body and said key cap are installed in a through hole extended from a outer surface to a inner surface of a face panel in such a manner that the annular flange of said springy key body is inserted into the through hole of said face panel, the flat annular base of said springy key body is affixed to the inner surface of said face panel, and the shank of said key cap and the triggering rods of said springy key body are respectively aimed at respective key switches of a circuit board.

3. The multi-function control key structure as claimed in claim 2, wherein the flat annular base of said springy key body is bonded to the inner surface of said face panel by heat welding.

4. The multi-function control key structure as claimed in claim 1, wherein the locating rods of said key cap are respectively bonded to the mounting holes of said first spring arms by heat welding.

* * * * *